US011408078B2

(12) United States Patent
Wawrzyniak et al.

(10) Patent No.: US 11,408,078 B2
(45) Date of Patent: Aug. 9, 2022

(54) METHOD FOR THE ANTI-CORROSION AND CLEANING PRETREATMENT OF METAL COMPONENTS

(71) Applicant: Henkel AG & Co. KGaA, Duesseldorf (DE)

(72) Inventors: Jerzy-Tadeusz Wawrzyniak, Duesseldorf (DE); Dalija Ehmann, Duesseldorf (DE); Nils Bongartz, Haan (DE); Matilde Senatore, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 92 days.

(21) Appl. No.: 16/902,352

(22) Filed: Jun. 16, 2020

(65) Prior Publication Data

US 2020/0308711 A1 Oct. 1, 2020

Related U.S. Application Data

(63) Continuation of application No. PCT/EP2018/083761, filed on Dec. 6, 2018.

(30) Foreign Application Priority Data

Dec. 20, 2017 (EP) ..... 17208833

(51) Int. Cl.
*C23F 11/04* (2006.01)

(52) U.S. Cl.
CPC ..... *C23F 11/04* (2013.01)

(58) Field of Classification Search
CPC ..... C23F 11/04; C23C 22/34; C23C 22/73; C23C 22/08; C23C 22/76; C23C 22/80
See application file for complete search history.

(56) References Cited

U.S. PATENT DOCUMENTS

| | | | | |
|---|---|---|---|---|
| 6,723,178 | B1 * | 4/2004 | Bannai | C23C 22/13 148/253 |
| 9,382,628 | B2 * | 7/2016 | Bongartz | C23C 22/83 |
| 2009/0255608 | A1 * | 10/2009 | Brouwer | C23C 22/365 148/241 |
| 2012/0325110 | A1 * | 12/2012 | Brouwer | C23C 22/34 106/1.22 |
| 2013/0230425 | A1 * | 9/2013 | DeChant | C23F 11/00 422/7 |
| 2017/0101721 | A1 * | 4/2017 | Post | C25D 5/34 |

FOREIGN PATENT DOCUMENTS

| | | | | |
|---|---|---|---|---|
| DE | 4417965 | A1 | 11/1995 | |
| DE | 102009047523 | A1 | 6/2011 | |
| DE | 102014225237 | B3 * | 4/2016 | C23C 22/78 |
| DE | 102014225237 | B3 | 4/2016 | |
| EP | 3230491 | A1 * | 10/2017 | C23C 22/78 |

OTHER PUBLICATIONS

Corrosion of Zinc and Zinc Alloyw by X Gregory Zhang Teck Cominico Metals Ltd ASM Handbook vol. 13B Corosino Materials p. 402-417 2005 (Year: 2005).*
International Search Report for PCT/EP2018/083761, dated Feb. 13, 2019.
EP Search Report for EP 17208833, dated May 28, 2018.

* cited by examiner

*Primary Examiner* — Pamela H Weiss
(74) *Attorney, Agent, or Firm* — Mary K. Cameron

(57) ABSTRACT

The invention relates to a multiple-step method for the corrosion-protective pretreatment of components, said pretreatment being at least partially produced from a metal material predominantly consisting of at least one of the elements iron zinc and/or aluminium, according to which the components are first brought into contact with an acid aqueous composition (A) containing water-soluble compounds of the elements Zr and/or Ti and then with an acid aqueous composition (B) containing phosphate ions and an accelerator. The method is particularly suitable for the pretreatment before an electrocoating.

18 Claims, No Drawings

METHOD FOR THE ANTI-CORROSION AND CLEANING PRETREATMENT OF METAL COMPONENTS

The present invention relates to a multi-stage process for the anti-corrosion pretreatment of components which are made at least in part of a metal material that is predominantly composed of one or more of the elements iron, zinc and/or aluminum, in which method the components are initially treated with an acidic aqueous composition (A) containing water-soluble compounds of the elements Zr and/or Ti and are then brought into contact with an acidic aqueous composition (B) containing phosphate ions and an accelerator. The method is particularly suitable for pretreatment before electrocoating.

The anti-corrosion pretreatment of metal surfaces before subsequent coating is carried out in the prior art, depending on the desired requirement profile and the type of coating to be applied, using different wet-chemical treatment methods, which are often based on the conversion of the metal surfaces with a homogeneous passivating coating with an inorganic material, where the inorganic material is deposited in a crystalline or amorphous manner by pickling the metal substrate as a sparingly soluble compound of a metal and/or semi-metal element. The metal and/or semi-metal element of the inorganic material deposited after the conversion of the metal surface originates either predominantly from the metal of the treated substrate, as in the case of non-layer-forming phosphating, for example iron phosphating, or from active components of these metal and/or semi-metal elements, as in the case of layer-forming phosphating, for example zinc phosphating. A person skilled in the art describes, as non-layer-forming, phosphating in the course of which only thin amorphous, but nevertheless largely homogeneous coatings are achieved and which are therefore usually only in layer deposits of less than 1 $g/m^2$ based on $PO_4$. In contrast, the layer-forming phosphating provides at least partially crystalline phosphate coatings, the layer deposit of which is regularly above 1.5 $g/m^2$. In particular phosphating is very well established as a method and is still an important anti-corrosion pretreatment method prior to electrocoating of components made of metal materials of the elements iron, zinc and/or aluminum, despite the time-consuming reprocessing of the phosphating bath and the rinsing water and the phosphate sludge produced during processing. Where the requirement profile with regard to corrosion protection and paint adhesion to such electrocoated materials is less demanding, attempts are often made to carry out non-layer-forming phosphating, which is particularly good for iron materials and provides homogeneous, thin amorphous coatings. Non-layer-forming phosphating is significantly less material-intensive and can be used with less effort in the preparation of the phosphating bath and the rinsing water due to the lower phosphate load.

DE 44 17 965 A1 describes such a phosphating solution for the non-layer-forming phosphating of surfaces made of steel, zinc and/or aluminum, where layer deposits of the phosphating in the region of 0.5-1 $g/m^2$ are to be achieved in particular on the iron surfaces, while moderate, roughness-increasing pickling takes place on surfaces of the materials which are predominantly composed of zinc and aluminum, which pickling is beneficial for the subsequent paint layer build-up on these materials. According to DE 44 17 965 A1, the phosphating bath necessarily contains dissolved phosphate, nitrobenzenesulfonic acid as an accelerator and monocarboxylic acids specified in more detail therein. The phosphating baths can also contain other auxiliary substances, for example free and/or complex-bound fluoride.

Compared to this prior art, the object is first that of reducing the phosphate sludge produced during non-layer-forming phosphating and, in methods with subsequent electrocoating, the required paint layer thickness while maintaining the same corrosion resistance. Another important aspect is to improve the passivation achieved with the non-layer-forming phosphating for subsequent electrocoating in such a way that, in the case of more complex components, the paint wrap is increased in regions of the component which are largely shielded from the electrical field of the electrocoating.

This object is achieved in a method for the anti-corrosion pretreatment of metal surfaces of such a component which consists at least in part of a metal material that is predominantly composed of one or more of the elements iron, zinc and/or aluminum, comprising the following successive method steps:

I) bringing the component into contact with an acidic aqueous composition (A) containing at least one water-soluble compound of the elements Zr and/or Ti;

II) bringing the component into contact with an acidic aqueous composition (B) containing phosphate ions and an accelerator.

According to the invention, a "metal material" is predominantly composed of one or more of the elements iron, zinc and/or aluminum if the sum of these elements in the material is greater than 50 at. %, preferably greater than 80 at. %. Such materials are steel, iron, zinc, aluminum, for example as a die-casting alloy, but also substrates plated with metal coatings in a layer thickness of at least 1 μm, in which case the metal coating is a material in the context of the present invention. Coatings of this kind are implemented in electrolytically or hot-dip galvanized steel, or in plating in the form of zinc (Z), aluminum silicon (AS), zinc magnesium (ZM), zinc aluminum (ZA), aluminum zinc (AZ) or zinc iron (ZF). The invention is characterized in that the materials mentioned are provided with anti-corrosion passivation which provides excellent corrosion protection and paint adhesion in particular on materials which predominantly consist of the element iron (so-called "iron materials"), for example on steels. Steel includes metal materials of which the mass fraction of iron is greater than that of every other element, and of which the carbon content, without taking into account carbides, is less than 2.06 wt. %. In a particular embodiment, the method according to the invention therefore comprises the anti-corrosion pretreatment of metal surfaces of a component which consists at least in part of a metal material that is predominantly composed of the element iron. However, since components which consist of different metal materials can also be successfully pretreated in the method according to the invention, a further preferred embodiment of the method according to the invention is characterized in that metal surfaces of components which consist of more than one metal material that is predominantly composed of one or more of the elements iron, zinc and/or aluminum are pretreated and are assembled (so-called "composite structure"), in particular components that consist at least in part of an iron material and are produced in a composite structure with a material that consists predominantly of one or both of the zinc and/or aluminum elements.

The components treated according to the present invention can be three-dimensional structures of any shape and design that originate from a manufacturing process, in particular also including semi-finished products such as strips, metal sheets, rods, pipes, etc., and composite structures assembled from said semi-finished products, the semi-finished products preferably being interconnected by means of adhesion, welding and/or flanging to form composite structures.

In the method according to the invention, due to the conversion treatment based on the elements Zr and/or Ti in method step I), in comparison to conventional non-layer-forming phosphating, a lower overall sludge formation is realized in the series treatment of a large number of components, and at the same time better corrosion and paint adhesion values are achieved. In the case of subsequent electrocoating of the components pretreated according to the invention, the latter lead to a significantly improved wrap behavior of the paint or, with the same wrap, to a smaller layer thickness of the paint deposited in the electrical field. In this way it is possible, with the same technical complexity, to increase the paint coating and thus the corrosion protection in regions of the component shielded from the electrical field, with lower paint layer thicknesses being achieved in regions of the component not shielded from the electrical field.

For a sufficient conversion of the metal surfaces of the component in method step (I), it is advantageous for the proportion of water-soluble compounds of the elements Zr and/or Ti in the acidic aqueous composition (A) of the method according to the invention to be a total of at least 0.05 mmol/kg, particularly preferably at least 0.1 mmol/kg, very particularly preferably at least 0.2 mmol/kg, where, for economic reasons and to prevent overpickling of the conversion layer, preferably a total of no more than 1.5 mmol/kg, particularly preferably a total of no more than 1.0 mmol/kg, of water-soluble compounds of the elements Zr and/or Ti are contained in an acidic aqueous composition (A) of the method according to the invention. In the context of the present invention, the term "water-soluble" comprises compounds which have a solubility in deionized water ($\kappa<1$ $\mu Scm^{-1}$) of at least 1 g/kg at 20° C.

Suitable representatives of the water-soluble compounds of the elements Zr and/or Ti which may be contained in the acidic aqueous composition (A) are compounds that dissociate in aqueous solution into anions of fluoro complexes. Preferred compounds of this kind are, for example, $H_2ZrF_6$, $K_2ZrF_6$, $Na_2ZrF_6$ and $(NH_4)_2ZrF_6$ and the analogous titanium compounds. Fluorine-free compounds of the elements Zr or Ti, in particular of the element Zr, can also be used according to the invention as water-soluble compounds, for example $(NH_4)_2Zr(OH)_2(CO_3)_2$ or $TiO(SO_4)$. In a preferred embodiment of the method according to the invention, fluorometallates of the elements Zr and/or Ti, and the fluoro acids thereof, particularly preferably hexafluorozirconates and/or hexafluorotitanates, and the free acids thereof, are contained in the acidic aqueous composition. According to the invention, the respective water-soluble compounds of the element Zr are preferably to be used rather than the compounds of the element Ti.

In addition, it can be advantageous for the rapid formation of a homogeneous conversion layer if one acidic composition (A) in method step (I) of the method according to the invention contains a source of fluoride ions. Any inorganic compound that can release fluoride ions when dissolved or dispersed in water is suitable as a source of fluoride ions. Complex or simple fluorides constitute one preferred source of fluoride ions. A person skilled in the art understands simple fluorides as being hydrofluoric acid and salts thereof such as alkali fluorides, ammonium fluoride or ammonium bifluoride, while, according to the invention, complex fluorides are coordination compounds in which fluorides are present in a coordinated manner as ligands of one or more central atoms. Accordingly, preferred representatives of the complex fluorides are the aforementioned fluorine-containing complex compounds of the elements Z and/or Ti.

The proportion of compounds that are a source of fluoride ions in an acidic aqueous composition of the method according to the invention is preferably at least large enough that an amount of free fluoride of at least 1 mg/kg, particularly preferably of at least 10 mg/kg, but preferably of no more than 100 mg/kg, results in the acidic aqueous composition (A). The free fluoride content is determined at 20° C. directly in the acidic aqueous composition (A) by means of a calibrated fluoride-sensitive electrode. If reference is made in the following to the free fluoride content, this must always be determined in an analogous manner directly in the composition in question.

Moreover, for optimum conversion, in particular of the surfaces made of iron material, by bringing into contact with an acidic aqueous composition (A), it is preferable for the molar ratio of total fluoride content to the total amount of the elements Zr and/or Ti to be greater than 4.5, preferably greater than 5.0, particularly preferably greater than 5.5. The total fluoride proportion is determined at 20° C. using a fluoride-sensitive electrode in a TISAB-buffered aliquot portion of an acidic aqueous composition (A) of the method according to the invention (TISAB: total ionic strength adjustment buffer), the mixture ratio by volume of buffer to the aliquot portion of the acidic aqueous composition (A) being 1:1. The TISAB buffer is prepared by dissolving 58 g NaCl, 1 g sodium citrate and 50 ml glacial acetic acid in 500 ml deionized water ($\kappa<1$ $\mu Scm^{-1}$), setting a pH of 5.3 using 5 N NaOH and filling to a total volume of 1000 ml, again with deionized water ($\kappa<1$ $\mu Scm^{-1}$). If reference is made in the following to the total fluoride content, this must always be determined in an analogous manner for the composition in question.

A first conversion of the metal surface of the component to be pretreated according to the invention with a corrosion-protective coating based on the elements Zr and/or Ti takes place in the acidic aqueous composition (A). For optimal process results, it is necessary here to strike a balance between the pickling and deposition rate, which leads to coatings that are ideally suited for the subsequent non-layer-forming phosphating. In this case, it has been found that the pH of the acidic aqueous composition (A) in method step (I) is preferably less than 5.8, particularly preferably less than 5.2, but preferably no less than 3.9, particularly preferably no less than 4.2, since even low pickling rates are sufficient to bring about a sufficient conversion of the metal surfaces. Nevertheless, for the provision of homogeneous conversion coatings, a specific pickling rate is required for forming an alkaline diffusion layer on the metal surfaces within which the precipitation of the layer components takes place. In this connection, methods are preferred according to the invention in which the acidic aqueous composition (A) has a free acid content of at least 1 point, but particularly preferably less than 5 points. The free acid is determined by diluting 2 ml of the acidic aqueous composition (A) to 50 ml using deionized water ($\kappa<1$ $\mu Scm^{-1}$), and titrating using 0.1 N sodium hydroxide solution to a pH of 4.0. The consumption of acid solution in ml indicates the point number of the free acid. If reference is made in the following to the free acid content in points, this must always be determined in an analogous manner for the composition in question.

In a preferred embodiment of the method according to the invention, in order to accelerate the conversion of the metal surfaces that are brought into contact with the acidic composition (A) in method step (I), the acidic aqueous composition (A) additionally contains at least one water-soluble compound that is a source of copper ions, preferably in the form of a water-soluble salt, for example copper sulfate, copper nitrate and copper acetate. The presence of copper ions is also advantageous for the anti-corrosion properties of the conversion coating formed on the metal surfaces of the components over the course of the conversion. The content of copper ions from water-soluble compounds in the acidic aqueous composition (A) is preferably at least 0.001 g/kg for this purpose, particularly preferably at least 0.005 g/kg. However, the content of copper ions is preferably not above 0.1 g/kg, particularly preferably not above 0.05 g/kg, since the deposition of elemental copper otherwise begins to dominate over the formation of the conversion coating.

Moreover, fora rapid and reproducible conversion of the metal surfaces, it is preferable according to the invention for the acidic aqueous composition (A) in methods according to the invention to additionally contain at least one water-soluble compound that has a standard reduction potential at pH 0 of above +0.2 V (SHE). The standard reduction potential of a redox pair E° (Ox/Red) is defined in the context of the present invention as the electrochemical voltage between the electrochemical half-cell containing the redox pair each having the thermodynamic activity of 1 at pH=0 and the half-cell of the standard hydrogen electrode (SHE) at a temperature of the electrolytes in the half-cells of 25° C. Water-soluble compounds which have such a standard reduction potential are preferably selected from inorganic nitrogen compounds, particularly preferably from nitric acid and/or nitrous acid and the salts thereof. The proportion of water-soluble compounds for accelerating the conversion layer formation is preferably at least 1 mmol/kg, more preferably at least 10 mmol/kg, but, for economic reasons, preferably less than 200 mmol/kg, based on the acidic aqueous composition (A).

In addition, the acidic aqueous composition (A) in method step (I) may contain at least one aliphatic saturated polyhydroxy compound which has at least 4, but no more than 8, carbon atoms. In this way, the acidic aqueous composition (A) can free the surfaces of the component from organic impurities without negatively influencing the formation of the conversion layer. This makes it possible to use methods according to the invention which have a cleaning effect in method step (I) and therefore may not have to resort to a preceding cleaning stage.

The aliphatic polyhydroxy compound to be used in this context is an aliphatic compound having more than two hydroxyl groups, preferably more than three hydroxyl groups, preferably at least two hydroxyl groups being interconnected by means of no more than two carbon atoms ("vicinal hydroxyl groups"). Particularly preferably, the polyhydroxy compounds are alditols that in turn preferably have no more than 6 carbon atoms and are particularly preferably selected from erythritol, threitol, xylitol, arabitol, ribitol, mannitol or sorbitol, and more particularly preferably are sorbitol.

In order to improve cleaning performance, a preferred acidic aqueous composition (A) containing the polyhydroxy compound preferably additionally contains at least one aliphatic diol which has at least 4 carbon atoms, but no more than 10 carbon atoms. The above-mentioned aliphatic diols are preferably selected from diols of which the hydroxyl groups are interconnected by means of no more than 3 carbon atoms, and particularly preferably from acyclic alkanediols which have no more than 8 carbon atoms, but preferably at least 5 carbon atoms, and particularly preferably are 2-methylpentane-2,4-diol.

In a preferred embodiment, the acidic aqueous composition (A) in method step (I) contains at least 0.01 wt. % of the aliphatic saturated polyhydroxy compound and optionally at least 0.003 wt. % of the aliphatic diol.

An excellent cleaning performance is achieved if the ratio by mass of above-mentioned polyhydroxy compounds to above-mentioned aliphatic diols is at least 0.4. Such a relative minimum amount of polyhydroxy compounds is therefore preferred in the acidic aqueous compositions (A) in the method according to the invention. Particularly preferably, the aforementioned ratio is at least 1.0, particularly preferably at least 2.0. If relative proportions of the above-mentioned polyhydroxy compounds are too high, in the case of an otherwise constant total number of active components, the high cleaning performance cannot be maintained and the simultaneous conversion of the metal surface also loses homogeneity. Accordingly, it is preferable in the method according to the invention for the ratio by mass of above-mentioned polyhydroxy compounds to above-mentioned diols in the preferred acidic aqueous composition (A) to be no greater than 20.0, particularly preferably no greater than 10.0, very particularly preferably no greater than 6.0.

Insofar as the component is brought into contact with an acidic aqueous composition (A) which additionally contains the above-mentioned mixture of aliphatic diols and aliphatic saturated polyhydroxy compounds, a preceding cleaning step can be dispensed with entirely. In a preferred embodiment of the method according to the invention, there is therefore no wet-chemical cleaning of the component immediately before the component is brought into contact with the preferred acidic aqueous composition (A) containing the above-mentioned mixture of aliphatic diols and aliphatic saturated polyhydroxy compounds in method step (II) of the component, in particular not if bringing into contact takes place by spraying on or splashing on.

According to the invention, wet-chemical cleaning is cleaning by bringing into contact with a water-based composition that contains a total of at least 0.1 wt. % of surfactants and/or wetting agents, surfactants and/or wetting agents comprising all organic compounds that lower the surface tension of water at 20° C. and at a proportion of 0.1 wt. %, determined using the Wilhelmy plate method.

A significant advantage of the method according to the invention, which method involves bringing into contact with an acidic aqueous composition (A) additionally containing a mixture of aliphatic diols and aliphatic saturated polyhydroxy compounds, is that the cleaning of auxiliary agents based on organic compounds, for example anti-corrosion oils, cutting oils and cooling lubricants from upstream production stages, from the metal surfaces of the component can be carried out successfully even at relatively low working temperatures. In a preferred embodiment of the method according to the invention, the bringing into contact of the acidic aqueous composition (A) therefore takes place when the temperature of the composition is less than 40° C., particularly preferably less than 35° C., more particularly preferably less than 30° C., but preferably at least 20° C. In this context it is also preferable for the bringing into contact of the acidic aqueous composition (A) in the method according to the invention to take place by spraying on or splashing on, particularly preferably by splashing on, more particularly preferably at a spraying pressure of at least 1 bar, in order to achieve optimal cleaning and rapid conversion of the metal surfaces.

In method step (I), a first conversion of the metal surfaces is intended to take place with a coating that temporarily protects against corrosion, which in turn is only a thin, almost completely inorganic, amorphous coating based on the elements Zr and/or Ti, and optionally cleaning of the component. Properties of a paint primer are therefore not intended to be imparted in the course of method step (I). Therefore, in a preferred embodiment of the process according to the invention, a total of less than 1 g/kg, particularly preferably less than 0.2 g/kg, of organic polymers are contained in the acidic aqueous composition (B). Organic polymers in this sense have a molecular weight of at least 1000 g/mol, determined on the basis of molecular weight distribution curves measured by gel permeation chromatography (GPC) with an RI detector after calibration using polystyrene standards after elution with tetrahydrofuran at a temperature of the eluate in the detector of 40° C.

It is further preferred for the acidic aqueous composition (A) in method step (I) to be "phosphate-free" and/or "chromium-free." According to the invention, a composition is "phosphate-free" if the proportion of phosphates dissolved in water is less than 100 mg/kg, preferably less than 20 mg/kg, calculated as the amount of phosphorus. According to the invention, a composition is "chromium(VI)-free" if the proportion of compounds of the element chromium dissolved in water in the oxidation stage +VI is less than 100 mg/kg, preferably less than 20 ppm.

Preferably immediately after the component has been brought into contact with the acidic aqueous composition (A) in method step (I), with or without an intermediate rinsing and/or drying step, preferably with a rinsing step, but particularly preferably without a drying step, in the method according to the invention bringing into contact with the acidic aqueous composition (B) in method step (II) for non-layer-forming phosphating takes place. The two wet-chemical method steps (I) and (II) can follow one another directly in a particularly optimized process sequence and therefore in a particularly preferred method according to the invention, without an intermediate rinsing step or an intermediate drying step taking place.

A "rinsing step" within the meaning of the present invention denotes a process which is intended solely to remove as far as possible, from the surface of the component, active components from an immediately preceding wet-chemical treatment step, which are dissolved in a wet film adhering to the component, by means of a rinsing solution, without replacing the active components to be removed with other active components. Active components in this context are constituents contained in a liquid phase which bring about an analytically detectable coating of the metal surfaces of the component with elemental constituents of the active components.

A "drying step" within the meaning of the present invention denotes a process in which the surfaces of the metal component that have a wet film are intended to be dried with the aid of technical measures, for example by supplying thermal energy or passing a stream of air thereover.

The modification of the metal surfaces of the component produced by bringing the composition (B) into contact in method step (II) requires a coating with phosphates. In a preferred embodiment of the method according to the invention, no phosphate coating is achieved on any of the metal surfaces of the component, which results in a layer weight of more than 1 g/m$^2$, particularly preferably less than 0.8 g/m$^2$, calculated as $PO_4$ (so-called "non-layer-forming phosphating"). However, a layer weight of at least 0.1 g/m$^2$, particularly preferably of at least 0.2 g/m$^2$, is preferably achieved on at least one of the metal surfaces, in particular on a surface of an iron material. Insofar as reference is made to the preferred non-layer-forming phosphating in the method according to the invention, activation of the metal surfaces is not necessary. In a preferred embodiment in which the low layer weights of phosphates of no more than 1 g/m$^2$ are to be achieved, it is therefore preferable for the method steps (I) and (II) to follow one another directly, with or without an intermediate rinsing step. The layer weight of phosphates is determined according to the invention after detaching the phosphate coating with aqueous 5 wt. % $CrO_3$ pickling solution at 25° C. for 5 minutes and determining the phosphorus content in the same pickling solution by means of plasma-coupled optical emission spectroscopy (ICP-OES). For higher layer weights, the treatment temperature, the treatment duration or the concentration of the phosphate ions or the accelerator can be increased, for example.

The coating of the metal surfaces of the component with phosphates produced in method step (II) by bringing into contact with the composition (B) is preferably obtained by means of compositions (B) which are substantially free of dissolved compounds of the element Ni, preferably substantially free of dissolved compounds of the elements Ni, Co and Cu and particularly preferably substantially free of dissolved compounds of the elements Ni, Co, Cu and Mn. Compositions (B) are substantially free of these heavy metals in the context of the present invention when the total content thereof is less than 100 ppm, preferably less than 10 ppm, based on the composition.

Water-soluble organic or inorganic compounds of which the standard reduction potential is greater than +0.2 V (SHE) can preferably be used as the accelerator contained in the composition (B) in the method according to the invention.

Suitable accelerators are preferably selected from organic or inorganic compounds containing at least one non-metal atom selected from nitrogen, phosphorus, oxygen, sulfur, chlorine and/or bromine in an oxidation stage which does not correspond to the lowest possible of the particular element, or at least one oxoanion of an element from subgroup VI B or VI I B of the periodic table. In the context of the present invention, the oxidation stage of an atom which is a constituent of a compound is defined as the hypothetical charge of the atom that would be present if only the binding electrons which are shared with atoms that have a lower electronegativity were fully attributed to the atom, while binding electrons that are shared with atoms of the same electronegativity would be attributed to the atom assuming a homolytic bond separation; the general IUPAC rules are used to determine the oxidation stage ("Oxidation State," IUPAC, Compendium of Chemical Terminology, Gold Book, Version 2.3.3, page 1049).

Preferred accelerators based on non-metal atoms selected from nitrogen, phosphorus, oxygen, sulfur, chlorine and/or bromine in an oxidation stage which does not correspond to the lowest possible of the particular element are nitrates, chlorates, bromates, aromatic nitro compounds such as nitrobenzenesulfonic acid, in particular m-nitrobenzenesulfonic acid, nitroarginine, 5-nitro-2-furfurylidenedicarboxylic acid, N-methylmorpholine-N-oxide, hydroxylamine, nitroguanidine, and hydrogen peroxide. Preferred accelerators based on the oxoanions of an element of subgroup VIB or VIIB of the periodic table are selected from molybdates, tungstates and/or manganates, particularly preferably from molybdates and/or tungstates. In order to achieve a sufficient coating with a thin phosphate coating, in particular on the surfaces of material which are predominantly composed of iron, it is advantageous to use compositions (B) which preferably contain a total of at least 0.1 mmol/kg, particularly preferably a total of at least 0.2 mmol/kg, very particularly preferably a total of at least 0.4 mmol/kg, of accelerators, but preferably no more than a total of 5 mmol/kg, particularly preferably a total of no more than 2 mmol/kg, very particularly preferably a total of no more than 1 mmol/kg, of accelerators.

In the method according to the invention, the proportion of phosphates in the composition should adequately cover at least the surfaces of the materials which are predominantly composed of iron. For this purpose, the composition (B) preferably contains at least 0.5 g/kg, particularly preferably at least 1 g/kg, of phosphate ions. For a resource-saving driving style, which also prevents sludge formation in this wet-chemical treatment step following the first conversion treatment, it is preferable for the composition (B) to contain no more than 10 g/kg, particularly preferably no more than 4 g/kg, of phosphate ions.

Furthermore, it has proven to be advantageous for a homogeneous coating result if the composition (B) additionally contains complexing agents, preferably selected from α-hydroxycarboxylic acids, preferably having at least 4, but no more than 8, carbon atoms, particularly preferably selected from citric acid, tartaric acid and/or gluconic acid and the water-soluble salts thereof.

A small amount of dissolved iron ions in the composition can be advantageous for homogeneous non-layer-forming phosphating, which then has a coating containing iron phosphate. In a preferred embodiment of the process according to the invention, therefore, the composition (B) contains at least 10 mg/kg, but preferably no more than 100 mg/kg, very particularly preferably no more than 50 mg/kg, of iron ions. This applies in particular to the treatment of metal components that consist at least in part of an iron material.

A pH of the composition (B) of less than 6.0, particularly preferably less than 5.2, is considered to be advantageous for sufficient pickling. In the method according to the invention, however, the pickling action of the composition (B) must be coordinated with the previous conversion treatment based on the elements Zr and/or Ti, so that the pH of the composition is preferably no less than 4.0, particularly preferably no less than 4.4, and very particularly preferably no less than 4.8, in order to minimize the corrosion of the conversion coating.

In this context, the total acidity of the composition (B) is an important control parameter. To provide a certain buffer capacity, this should preferably be at least 1 point, particularly preferably at least 3 points, but in order to avoid over-pickling of the conversion-treated metal surfaces of the component, it should preferably be no greater than 16 points, particularly preferably no greater than 9 points. The overall acid content in points is determined in the context of the present invention by diluting 10 ml of the pickling solution to 50 ml and titrating with 0.1 N sodium hydroxide solution to a pH of 8.5. The consumption of milliliters of sodium hydroxide solution indicates the point number.

Furthermore, it is advantageous for the integrity of the conversion coating based on the elements Zr and/or Ti that the proportion of water-soluble compounds which release fluoride ions is low. However, small amounts of such compounds, in particular of complex-bound fluorides, are tolerated, so that in a preferred embodiment of the method according to the invention, a rinsing step immediately after method step (I) and immediately before method step (II) can be dispensed with. In a preferred embodiment of the method according to the invention, however, the proportion of free fluoride in the aqueous composition is less than 10 mg/kg, particularly preferably less than 5 mg/kg, very particularly preferably less than 1 mg/kg. In a particularly preferred embodiment of the method, the total fluoride content in the composition (B) is also less than 100 mg/kg, preferably less than 50 mg/kg, particularly preferably less than 10 mg/kg.

For non-layer-forming phosphating in method step (II), the composition (B) should preferably contain less than 1 g/kg, particularly preferably less than 0.5 g/kg, very particularly preferably less than 0.2 g/kg, of zinc ions.

The presence of organic polymeric constituents in the composition (B) can be tolerated to a certain degree, for example for complexing metal ions. However, the presence of polymeric components usually complicates bath maintenance considerably and can prevent the formation of an amorphous phosphate layer or at least shift it to the disadvantage of a coating which substantially consists of polymeric components. It is therefore preferable according to the invention for the acidic aqueous composition (B) to contain a total of less than 1 g/kg, particularly preferably less than 0.2 g/kg, of organic polymers. Organic polymers in this sense have a molecular weight of at least 1000 g/mol, determined on the basis of molecular weight distribution curves measured by gel permeation chromatography (GPC) with an RI detector after calibration using polystyrene standards after elution with tetrahydrofuran at a temperature of the eluate in the detector of 40° C.

It is further preferred for the acidic aqueous composition (B) in method step (II) to be "chromium-free."

Directly after the component has been brought into contact with the acidic aqueous composition (B) in method step (II), with or without an intermediate rinsing and/or drying step, preferably with a rinsing step but particularly preferably without a drying step, in the method according to the invention the regions of the component which have previously been brought into contact with the acidic aqueous composition (B) are preferably coated at least in part, preferably based on an organic film former, particularly preferably dip coated, particularly preferably electrocoated. Cathodic electrocoating is particularly preferred, the cathodic electrocoating preferably being based on an aqueous dispersion of an amine-modified film-forming polyepoxide, which preferably also comprises blocked and/or unblocked organic compounds containing isocyanate groups as hardeners and, if appropriate, small amounts of compounds of the elements yttrium and/or bismuth that are dissolved in the aqueous phase.

PRACTICAL EXAMPLES

To illustrate the teaching according to the invention, cold-rolled steel sheets (ST 1405 Sidca®, ThyssenKrupp Steel AG) were subjected to a series of wet-chemical pre-treatment steps and then provided with a cathodic electrocoat (binder GV 85-0030, pigment GV 86-0320; both BASF AG). The cathodic electrocoating was carried out at a deposition voltage of 220 V for 5 minutes. The pre-treatment steps comprised:

A1. Alkaline cleaning in spraying at 50° C. for 60 seconds in a degreasing bath composed of equal parts of a 1 wt. % Bonderite® C-AK 6443 and a 0.2 wt. % Bonderite® C-AD 10004 (both Henkel AG & Co. KGaA)

A2. Conversion treatment at 23° C. for 60 seconds (A2a) or 30 seconds (A2b) by spraying using an aqueous composition with a pH of 4.8, containing
16.2 g/kg hexafluorozirconic acid 32.0 g/kg magnesium nitrate hexahydrate
21.0 g/kg sorbitol
9.9 g/kg hexylene glycol A3. Phosphating at 50° C. for 60 seconds by spraying using an aqueous composition with a pH of 4.8, containing
3.26 g/kg phosphoric acid
0.26 g/kg m-nitrobenzenesulfonic acid
0.11 g/kg hydroxylamine sulfate
0.58 g/kg alkoxylated turpentine oil
0.20 g/kg ethoxylated-propoxylated C12 fatty alcohol B1. Immersion rinsing with city water at 23° C. for 60 seconds B2. Flushing with deionized water ($\kappa<1$ $\mu Scm^{-1}$) at 23° C. for 25 seconds A method sequence according to the invention for pretreatment (A2a-B1-B2-A3) comprising the cleaning conversion treatment A2 followed by the phosphating A3 was compared with a conventional method sequence (A1-B1-B2-A2b) comprising alkaline cleaning and conversion treatment. The conventional pretreatment produces a layer thickness of approximately 20 μpm in the dip coating, whereas with the pretreatment according to the invention, a dip coating layer thickness of 8 μm resulted in homogeneous coverage. Conventional phosphating according to method step A3 without preceding conversion treatment requires a comparatively longer phosphating time to achieve similarly low layer thicknesses and causes significantly higher contamination with phosphate sludges in the technical implementation during series production.

What is claimed is:

1. A method for the anti-corrosion pretreatment of metal surfaces, comprising the following successive method steps:

I) contacting metal surfaces of a component, which-comprises a metal material composed of one or more of iron, zinc and/or aluminum, with an acidic aqueous composition (A) containing at least one water-soluble compound of the elements Zr and/or Ti and at least one aliphatic saturated polyhydroxy compound selected from the group consisting of erythritol, threitol, xylitol, arabitol, ribitol, mannitol, sorbitol and combinations thereof;

II) contacting the component with an acidic aqueous composition (B) containing phosphate ions and an accelerator, which composition has a total content of less than 100 ppm of dissolved compounds of the element Ni, wherein no phosphate coating is achieved on any of the metal surfaces of the component that results in a layer weight of more than 1 $g/m^2$, calculated as $PO_4$.

2. The method according to claim 1, wherein the composition (A) contains at least 0.05 mmol/kg, but no more than 1.5 mmol/kg of water-soluble compounds of the elements Zr and/or Ti, based on these elements.

3. The method according to claim 1, wherein the composition (A) has a pH of less than 5.8, but no less than 3.9.

4. The method according to claim 1, wherein the composition (A) additionally contains a water-soluble source for fluoride ions in such an amount that free fluoride amount is at least 1 mg/kg, but no more than 100 mg/kg.

5. The method according to claim 1, wherein the composition (A) further comprises at least one aliphatic diol, which has at least 4 carbon atoms, but no more than 10 carbon atoms.

6. The method according to claim 1, wherein the composition (B) contains at least 0.5 g/kg, but no more than 10 g/kg of phosphate ions.

7. The method according to claim 1, wherein the accelerator in the composition (B) is selected from at least one water-soluble organic or inorganic compound of having a standard reduction potential greater than +0.2 V (SHE).

8. The method according to claim 1, wherein the accelerator in the composition (B) is selected from organic or inorganic compounds containing at least one non-metal atom selected from the elements nitrogen, phosphorus, oxygen, sulfur, chlorine and/or bromine in an oxidation stage which does not correspond to the lowest possible oxidation stage of the particular element; or at least one oxoanion of an element from subgroup VIB or VIIB of the periodic table.

9. The method according to claim 1, wherein the composition (B) contains a total of at least 0.1 mmol/kg, but no more than 5 mmol/kg, of accelerators.

10. The method according to claim 1, wherein the composition (B) has a pH of less than 6.0, but no less than 4.0.

11. The method according to claim 4, wherein the fluoride ions in the composition (B) are less than 10 mg/kg and total fluoride content is less than 100 mg/kg.

12. The method according to claim 1, wherein composition (B) comprises zinc ions in an amount that is less than 1 g/kg.

13. The method according to claim 1, further comprising coating-the metal surfaces with an organic film former.

14. The method according to claim 1, wherein the component comprises an iron material and is produced in a composite structure with a material which is composed of one or both of the elements zinc and aluminum.

15. The method according to claim 1, wherein the at least one aliphatic saturated polyhydroxy compound is selected from the group consisting of xylitol, arabitol, ribitol, mannitol, sorbitol and combinations thereof.

16. The method according to claim 15, wherein the at least one aliphatic saturated polyhydroxy compound is selected from the group consisting of xylitol, arabitol, ribitol and combinations thereof.

17. The method according to claim 1, wherein the at least one aliphatic saturated polyhydroxy compound is sorbitol.

18. The method of claim 13, wherein the coating step further comprises electrocoating.

* * * * *